US011005219B2

(12) United States Patent
Simpson

(10) Patent No.: US 11,005,219 B2
(45) **Date of Patent: *May 11, 2021**

(54) GAUSSIAN CHAMBER CABLE DIRECT CONNECTOR

(71) Applicant: Terrell Simpson, Round Rock, TX (US)

(72) Inventor: Terrell Simpson, Round Rock, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/672,440

(22) Filed: Nov. 2, 2019

(65) Prior Publication Data

US 2020/0136280 A1 Apr. 30, 2020

Related U.S. Application Data

(63) Continuation of application No. 15/995,096, filed on May 31, 2018, now Pat. No. 10,490,915.
(Continued)

(51) Int. Cl.
*H01R 9/05* (2006.01)
*H01R 13/6591* (2011.01)
(Continued)

(52) U.S. Cl.
CPC ..... *H01R 13/65918* (2020.08); *H01R 9/03* (2013.01); *H01R 9/05* (2013.01);
(Continued)

(58) Field of Classification Search
CPC . H01R 9/05; H01R 9/03; H01R 9/038; H01R 13/6473; H01R 13/6589; H01R 13/6592; H01R 43/24; H01R 2107/00
(Continued)

(56) References Cited

U.S. PATENT DOCUMENTS 3,529,276 A * 9/1970 Hennessey, Jr. ..... H01R 13/62933 439/310
4,085,284 A * 4/1978 Olszewski ..... H01B 11/085 174/106 R
(Continued)

OTHER PUBLICATIONS

Analog Devices, "EMI, RFI, and Shielding Concepts", MT-095, Tutorial, 2015.
(Continued)

*Primary Examiner* — Abdullah A Riyami
*Assistant Examiner* — Vladimir Imas
(74) *Attorney, Agent, or Firm* — Ortiz & Lopez, PLLC; Kermit D. Lopez; Luis M. Ortiz

(57) ABSTRACT

A connector system, method and apparatus for an EMI enclosure such as a Gauss/Faraday cage or chamber. The connector system, method and/or apparatus includes one or more individual conductors located within the EMI enclosure to eliminate EMI/E&H field effects with respect to applications such as a small form factor cable applications, high density cable applications, and a high speed (e.g., greater than 1 Gbps) multiconductor copper-based cable applications. This approach therefore isolates individual or multiple cable signals (e.g., single conductors) within individual Gaussian/Faraday cages to eliminate EMI/E&H field effects for small form factor, high density, high speed (e.g., >1 Gbps) multiconductor copper based cable applications.

19 Claims, 5 Drawing Sheets

Related U.S. Application Data

(60) Provisional application No. 62/516,182, filed on Jun. 7, 2017.

(51) Int. Cl.

| | |
|---|---|
| ***H01R 43/24*** | (2006.01) |
| ***H01R 13/6589*** | (2011.01) |
| ***H01R 13/6592*** | (2011.01) |
| ***H01R 9/03*** | (2006.01) |
| *H01R 107/00* | (2006.01) |
| *H01R 13/6473* | (2011.01) |

(52) U.S. Cl.
CPC ..... *H01R 13/6589* (2013.01); *H01R 13/6592* (2013.01); *H01R 43/24* (2013.01); *H01R 13/6473* (2013.01); *H01R 2107/00* (2013.01)

(58) Field of Classification Search
USPC ..... 439/579
See application file for complete search history.

(56) References Cited

U.S. PATENT DOCUMENTS 4,398,783 A * 8/1983 Kelly ..... H01R 23/688 439/581
4,468,080 A * 8/1984 Van Brunt ..... H01R 9/032 174/359
4,640,980 A * 2/1987 Batt ..... H05K 9/00 174/36
4,655,159 A * 4/1987 McMills ..... B25B 23/14 116/212
4,749,895 A 6/1988 Ruelle
5,011,432 A * 4/1991 Sucht ..... H01R 9/05 439/584
5,033,032 A * 7/1991 Houghtaling ..... B06B 1/0688 367/152
5,180,314 A * 1/1993 Gelin ..... H01R 9/0509 439/394
5,575,667 A * 11/1996 Mehez ..... H01R 9/032 439/579
5,752,855 A * 5/1998 Mehez ..... H01R 9/032 439/108
6,218,745 B1 * 4/2001 Bodin ..... H01R 13/6658 307/104
6,335,482 B1 * 1/2002 Mason ..... H01R 9/05 174/359
6,498,710 B1 * 12/2002 Anthony ..... H01G 4/012 257/E23.079
6,603,646 B2 * 8/2003 Anthony ..... H01G 4/012 257/E23.079
6,887,105 B2 * 5/2005 Knighten ..... H01R 13/6473 439/607.24
7,121,888 B2 * 10/2006 Brandt ..... H01R 13/512 439/607.05
7,190,053 B2 * 3/2007 Orth ..... H05K 1/0218 257/659
7,273,393 B2 * 9/2007 van Meijl ..... H01R 13/6592 439/579
7,301,748 B2 * 11/2007 Anthony ..... H01L 23/49822 257/E23.062
7,311,552 B1 12/2007 Ko
7,423,860 B2 * 9/2008 Anthony ..... H01G 4/012 257/E23.079
7,537,461 B2 5/2009 Rathburn
7,550,826 B2 * 6/2009 Orth ..... H05K 1/0218 257/659
7,582,951 B2 * 9/2009 Zhao ..... H01L 23/3128 257/660
7,609,501 B2 * 10/2009 Anthony ..... H01L 23/49822 361/118
7,632,122 B2 * 12/2009 Pesant ..... H01R 24/44 439/188
7,687,725 B2 3/2010 Hogan
7,733,621 B2 * 6/2010 Anthony ..... H01L 23/49822 361/118
7,752,970 B2 * 7/2010 Nelson ..... F42D 1/05 102/215
7,934,954 B1 * 5/2011 Chawgo ..... H01R 9/0524 439/578
8,019,225 B2 * 9/2011 Daghighian ..... H04B 10/40 398/135
8,056,226 B2 * 11/2011 Hughes ..... H01R 31/08 29/883
8,067,701 B2 11/2011 Keiper et al.
8,095,224 B2 * 1/2012 Truex ..... A61B 5/0031 607/115
8,294,043 B2 * 10/2012 Munoz ..... H01R 13/6595 174/359
8,422,195 B2 * 4/2013 Stevenson ..... H01G 4/35 361/302
8,487,416 B2 * 7/2013 Delgado ..... H01L 23/552 257/659
8,525,045 B2 9/2013 Yamaguchi et al.
8,528,205 B2 * 9/2013 Hughes ..... H01R 31/08 29/883
8,692,114 B1 * 4/2014 Popescu ..... H05K 9/0018 174/71 R
8,744,583 B2 * 6/2014 Lavie ..... A61N 1/3754 607/37
8,979,591 B2 * 3/2015 Mehnert ..... H01R 13/622 439/607.41
9,172,154 B2 * 10/2015 Burris ..... H01R 9/05
9,306,340 B2 * 4/2016 Chen ..... H01R 13/6616
9,444,197 B2 * 9/2016 Goebel ..... H01R 13/6581
9,450,339 B2 * 9/2016 Gao ..... H01R 13/6582
9,490,588 B2 * 11/2016 Keyser ..... H01R 13/6592
9,548,572 B2 * 1/2017 Burris ..... H01R 9/0521
9,625,545 B2 4/2017 Dumoulin
9,647,394 B2 * 5/2017 Goebel ..... H01R 13/6581
D790,473 S 6/2017 Chen et al.
9,762,008 B2 * 9/2017 Burris ..... H01R 24/40
9,929,487 B2 3/2018 Chen et al.
9,991,651 B2 * 6/2018 Burris ..... H01R 9/0521
10,141,692 B2 * 11/2018 Goebel ..... H01R 13/6581
2003/0221866 A1 12/2003 Tang
2017/0041044 A1 2/2017 Ivanov et al.
2017/0237213 A1 8/2017 Gao et al.
2017/0311435 A1 10/2017 Ohsawa et al.
2017/0373448 A1 12/2017 Burris et al.
2018/0034216 A1 2/2018 Zhong et al.

OTHER PUBLICATIONS

Wikipedia, "Faraday cage", https://en.wikipedia.org/wiki/Faraday_cage, Downloaded May 7, 2017.
Wikipedia, "PCI Express", https://en.wikipedia.org/wiki/PCI_Express, Downloaded May 7, 2017.
Margaret Rouse, "Peripheral Component Interconnect Express (PCIe, PCI-E)", Tech Target, Apr. 30, 2015.
SGC Knowledge Center / I-PEX Connectors, TMP Sales, Inc, 2018.
U.S. Appl. No. 15/995,096; Non-Final Rejection, dated Feb. 20, 2019.
U.S. Appl. No. 15/995,096, filed Feb. 20, 2019.
U.S. Appl. No. 15/995,096; Notice of Allowance and Fees Due, dated Jul. 29, 2019.

* cited by examiner

GAUSSIAN CHAMBER CABLE DIRECT CONNECTOR

CROSS-REFERENCE TO PATENT APPLICATIONS

This patent application is a continuation of U.S. patent application Ser. No. 15/995,096 entitled "Gaussian Chamber Cable Direct Connector," which was filed on May 31, 2018, and is incorporated herein by reference in its entirety. U.S. patent application Ser. No. 15/995,096 in turn claims priority under 35 U.S.C. 119(e) to U.S. Provisional Patent Application Ser. No. 62/516,182, entitled "Gaussian Chamber Cable Direct Connector," which was filed on Jun. 7, 2017, the disclosure of which is also incorporated herein by reference in its entirety. This patent application therefore claims priority to the Jun. 7, 2018 filing date of U.S. Provisional Patent Application Ser. No. 62/516,182.

TECHNICAL FIELD

Embodiments are related to the field of data communications. Embodiments are also related to EMI (Electromagnetic Interference) control methods and systems, and electronic devices. Embodiments further relate to a Gaussian or Faraday chamber direct connector apparatus.

BACKGROUND

A Gaussian or Faraday cage or chamber is an enclosure used to block electromagnetic fields. A Faraday shield or cage/chamber may be formed by a continuous covering of conductive material or in the case of a Faraday cage, by a mesh of such materials. Faraday cages are named after the English scientist Michael Faraday, who invented them in 1836. A Faraday cage operates because an external electrical field causes the electric charges within the cage's conducting material to be distributed such that they cancel the field's effect in the cage's interior. This phenomenon is used to protect sensitive electronic equipment from external radio frequency interference. Faraday cages are also used to enclose devices that produce RFI, such as radio transmitters, to prevent their radio waves from interfering with other nearby equipment. They are also used to protect people and equipment against actual electric currents such lighting strikes and electrostatic discharges, since the enclosing cage conducts current around the outside of the enclosed space and none passes through the interior.

Faraday cages cannot block static or slowly varying magnetic fields, such as the Earth's magnetic field. To a large degree, though, they shield the interior from external electromagnetic radiation or EMI (Electromagnetic Interference) if the conductor is thick enough and any holes are significantly smaller than the wavelength of the radiation. For example, certain computer forensic test procedures of electronic systems that require an environment free of electromagnetic interference can be carried out within a screened room. These rooms are spaces that are completely enclosed by one or more layers of a fine metal mesh or perforated sheet metal. The metal layers are grounded to dissipate any electric currents generated from external or internal electromagnetic fields, and thus they block a large amount of the EMI. They provide less attenuation from outgoing transmissions versus incoming: they can shield EMP waves from natural phenomena very effectively, but a tracking device, especially in upper frequencies, may be able to penetrate from within the cage.

One problem with conventional Faraday and/or Gaussian cages or chambers is how to implement a single or paired flexible solid or stranded core (e.g., paired set) that can perform similar to a semi-rigid wire to allow high frequency signals to be sent through a metal container that contains a strong energy field. In some cases, the paired sets may be differential. The latest technique for managing the energy field involves placing a ground signal between the pairs to attempt to bring the energy towards zero. Containing the energy of a single or a pair of flexible stranded or solid cores within a Faraday or Zero Gauss Chamber will allow the energy to be contained effectively to deliver improved signal integrity.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is, therefore, one aspect of the disclosed embodiments to provide for an improved connector apparatus that protects internal and external electronic interconnect components.

It is another aspect of the disclosed embodiments to provide for an improved connector apparatus that includes a single or paired set of wire cores terminated to a connector contact or contacts, and/or mated contact sets (e.g., a plug contact mated to receptacle contact), from EMI and which further provides improved field energy isolation between and/or within various components/elements within an interconnect system to enhance signal integrity characteristics and thereby improve overall interconnect system performance.

It is a further aspect of the disclosed embodiments to provide for a specialized connected that can be used for sensitive instrumentation signals for individual conductors, and in which high integrity signals or paired signals are contained in a single connector.

It is still another aspect of the disclosed embodiments to provide for a connector apparatus that facilitates EMC (Electromagnetic Compatibility) standards.

It is still another aspect of the disclosed embodiments to provide for an improved cable direct connector apparatus and wire termination method for an electromagnetic protective chamber or enclosure such as a Gaussian and/or Faraday chamber. Note that there are several existing form factors (e.g., shell convers in Ziff style connector systems such as JAE's HD1 Series or I-PEX Cabline Series Connectors) that can be easily modified to implement the approached discussed herein. Namely, such shell convers can be stamped to allow isolation wall to exist between signals or pairs of signals within existing connector systems to affect the signal integrity characteristics thereby improving overall system performance.

It is another aspect of the disclosed embodiments to provide for an apparatus and system for use with an electromagnetic protective chamber that includes the use of EMI (Electromagnetic Interference) absorption metal and an internal commonly grounded geometry such as (but not limited to) a cylinder, honeycomb or even a boxed containment shape component for maintaining and supporting center a conductor such as an SGC (Small Gauge Coax) cable center conductor or a pair of coaxial (Twin Small Gauge Coaxial) wire center conductors.

The aforementioned aspects and other objectives and advantages can now be achieved as described herein. Connector systems, methods and devices for an EMI enclosure such as a Gaussian/Faraday cage or chamber are disclosed herein. Such a connector system, method and/or apparatus can be configured to include one or more individual conductors located within the EMI enclosure to eliminate EMI/E&H field effects with respect to applications such as a small form factor cable applications, high density cable applications, and a high speed (e.g., greater than 1 Gbps) multiconductor copper-based cable applications. Such a Gaussian/Faraday chamber cable direct connector therefore isolates an individual cable signal or a paired cable signals (i.e., single or twin conductors) within individual Gaussian/Faraday cages to eliminate EMI/E&H field effects between signals or signal pairs for small form factor, high density, high speed (e.g., greater than 1 Gbps) multiconductor copper based cable applications.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

Figure 1:
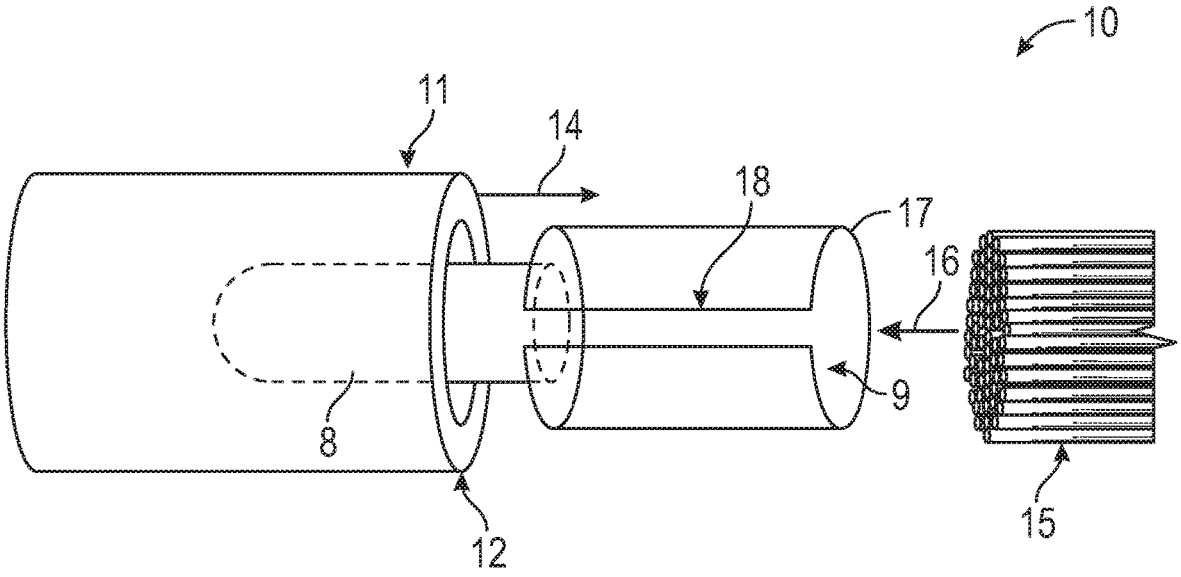
FIG. 1 illustrates a side pictorial diagram depicting an EMI enclosure interconnect system, in accordance with an example embodiment.

The particular values and configurations discussed in these non-limiting examples can be varied and are cited merely to illustrate at least one embodiment and are not intended to limit the scope thereof.

The embodiments will now be described more fully hereinafter with reference to the accompanying drawings, in which illustrative embodiments of the invention are shown. The embodiments disclosed herein can be embodied in many different forms and should not be construed as limited to the embodiments set forth herein; rather, these embodiments are provided so that this disclosure will be thorough and complete, and will fully convey the scope of the invention to those skilled in the art. For example, preferred and alternative embodiments are disclosed herein.

Additionally, like numbers refer to identical, like or similar elements throughout, although such numbers may be referenced in the context of different embodiments. As used herein, the term "and/or" includes any and all combinations of one or more of the associated listed items.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The disclosed Gaussian/Faraday interconnect embodiments are directed to a solution for configuring a flexible solid or stranded core wire or a pair of wires or multi-core wires that perform operations similar to a semi-rigid wire, but in which high frequency signals are capable of being transmitted through a metal container possessing a strong field energy. These features are based on the observation that a semi-rigid wire is similar to a Gaussian chamber or Faraday cage. Such a wire concept is very much in line with the 1923 work by British scientists Willoughby S. Smith and Henry J. Garnett for inductive loading of submarine telegraph cables. The disclosed embodiments are based on the concept that a similar small gauge wire can be developed for applications wherein the energy can be contained not only through the wire but through an interconnect (connector) in a similar fashion.

Some example embodiments can employ the use of, for example, Mu Metal, Nickel, Nickel-Cobalt or other permeable metals and Faraday cages or Gauss Chamber. It should be appreciated that the disclosed embodiments are not limited to such metals, which are referred to herein for exemplary purposes only. A connector contact as used herein can be configured with, for example, standard materials and a small gauge coaxial wire. Experimental data is disclosed herein (e.g., see FIGS. 5-10) based on an experimental simulation of potential performance expectations for two data pairs.

The disclosed embodiments describe devices and systems (and methods thereof) to contain the electric field generated by each conductor or differentially paired conductors within an electromagnetic protective enclosure such as Gauss/Faraday cage that is fully short circuited to ground: namely, each Gauss/Faraday cage that surrounds each conductor/multi-conductor can be short circuited to its neighbor, and the commonly grounded cages are then connected to ground through the receptacle and subsequently to system ground.

A major paradigm shift in such embodiments from conventional systems and methods is the use of Gauss/Faraday concepts and permalloy type materials that will adsorb field energy to isolate signals that are paired to deliver differential signals. This approach can be applied to a number of existing interconnects with little modification to arrive not only at a connector configuration, but also incremental but significant changes to existing interconnects in industry. Isolating signals in this manner will also have the added benefit of eliminating separate ground signals between data pairs thus reducing the form footprint. The VESA industry standard for high-speed video signals, for example, separates data pairs with a ground signal between pairs to attenuate the energy between pairs. This has had a significant impact on the industry's ability to deliver signals significantly into high double digit data rates and frequencies. Semi-Rigid wires handle frequencies in the 90 GHz range which equates to triple digit data rates: 180 Gbps in this case. In a similar but unique manner, a data pair can be enclosed together thus eliminating cross-talk and other signal integrity effects.

The most interesting aspect of the disclosed embodiments is the effect that the use of Gauss/Faraday chambers to isolate field energies between signals has on the signal integrity characteristics of the system; it demonstrates a potential to reduce Insertion Loss by, for example, less than 2 dB compared to most industry cables which have typical ranges greater than, for example, 6 dB. As is shown in the simulation graphs depicted in FIGS. 5-10 herein, the insertion loss (IL) is only a fraction of 1 dB with return loss (RL) less than −23 dB through 40 GHz. Moreover, with Mode conversion less than, for example, 60 dB through 40 GHz, this means the potential exists for this solution to have a major impact on the industry.

The most attractive aspect is the commercial viability of a high density, small form factor product capable of delivering such a high level of performance. Conventional industry solutions are very expensive in nature and because of that are not commercially viable solutions for mainstream product offerings in the market place. This does not even include the increased benefits of being able to deliver highly clean data signals at faster data rates and smaller gauges in high density. This could dramatically increase bandwidth for video and other applications.

An important and immediate application for this product involves test and standards compliance validation equipment setups, server applications in IT centers and visual simulation applications for Flight simulation training systems (e.g., NASA). In addition, cabling for devices such as, for example, a PCIe Gen 5 (e.g., ~32 Gbps) for Dell/EMC, HP and Intel offer a great solution for server needs as well. Other examples can be implemented in a number of industry applications ranging from Aerospace to Military warfare including UAV's.

Other than deciding the most cost effective manufacturing method to preserve the simulated performance results we expect we have not conceived of any disadvantages outside of existing connector manufacturers realizing the potential to apply this to their product lines thereby making their product more competitive with ours. The material selection of permeable alloys could have a potential effect on manufacturing cost. The present inventor believes that existing manufacturing equipment and techniques can be employed for one or more embodiments; however, these materials may need to be annealed and that may drive cost somewhat but to what extent depends on the demand volume.

FIG. 1 illustrates a side pictorial diagram depicting an EMI enclosure interconnect system 10, in accordance with an example embodiment. The system 10 includes an EMI enclosure or chamber 11 such as a Gaussian/Faraday chamber that protects internal devices and components from EMI (Electromagnetic Interference). The chamber 11 is configured from an EMI absorption metal. In the example embodiment shown in FIG. 1, the chamber 11 can be configured in the shape of a cylinder but may take on any appropriate geometry sufficient to deliver an affective Gauss/Faraday Chamber. That is, although some of the embodiments discussed herein disclose a cylindrically shaped chamber or enclosure, it can be appreciated that other geometries can be utilized in accordance with other embodiments.

As further shown in FIG. 1, an insulator ring 12 is generally disposed within the chamber 11. The insulator ring 12 surrounds an internal cylindrical component 17 that includes a soldered slit 18. The cylindrical component 17 in turn surrounds a centrally located conductor 15 (e.g., an SGC cable center conductor) and a contact pin 8. The arrows 14 and 16 in FIG. 1 demonstrate the interconnect direction of placement for connecting the various features shown in FIG. 1.

Note that the term "SGC" as utlized herein can refer to "Small Gauge Coax" or in some cases "Shielded Grounded Cases". SGC refers to a range of wire gauges that are of a coaxial cable construction and occasionally includes the use of the term TGC referring to Twin-ax or Twin Gauge Coaxial Wires. Coaxial cable involves the use of a wire (center conductor) that has either an extruded insulator over it or taped insulator over it (sometimes referred to as a "dialectic" material), a braided wire shield over that insulator and then an outer jacket. Another acronym used to describe the smaller wire gauges of SGC is "MCX" which means "micro-coaxial". Micro-coaxial cable is usually termed as such when wire gauges are in the 28-56 AWG, generally. Wires of that size are about the thickness of a human hair. "Micro-coax" and "small gauge coax" are often used to describe the same coaxial cable or connector.

In addition, note that as utlized herein, the acronym EMI refers generally to "Electromagnetic Interference". The acronym EMI can be utilized herein to also refer to EMI and/or E&H interference, where "E" refers generally to an electric field and "H" refers generally to a magnetic field. Thus, the term EMI can also refer to "E&H" or EMI/E&H.

The chamber 11 (e.g., a Gaussian Chamber) is fully grounded and protects the coaxial wire composite center conductor 15 from EMI interference. The solder slits 18 allow for proper soldering flow and the contact pin 8 is maintained generally within the chamber 11. The contact pin 8 can be configured to match the wire gauge of the center conductor 15. In addition, the soldered cylinder 17 can be insulated from the terminal and can include a wall configured as thin as possible.

Figure 2:
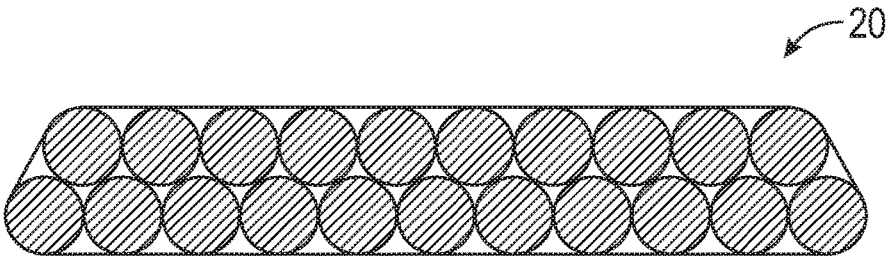
FIG. 2 illustrates a cross-sectional view of a of an EMI enclosure plug house, in accordance with an example embodiment.

FIG. 2 illustrates a cross-sectional view of a of an EMI enclosure plug house 20, in accordance with an example embodiment. In the example embodiment shown in FIG. 2, the plug house 20 can be composed of multiple chambers such as, for example, chamber 11 shown in FIG. 1. An example of chamber 11 in the context of the EMI enclosure plug house 20 is shown toward the left handside of FIG. 2. It can be appreciated that the plug house 20 may be configured with a number of such chambers. The plug house 20 can be configured in the context of an array or honeycomb arrangement, or any other appropriate form, for maintaining multiple chambers. That is, it can be appreciated that the disclosed embodiments are not limited to such an array or honeycomb arrangement but can implemented in the context of other configurations and geometries. The aforementioned array or honeycomb arrangement is thus provided only for general edification and exemplary purposes only.

Figure 3:
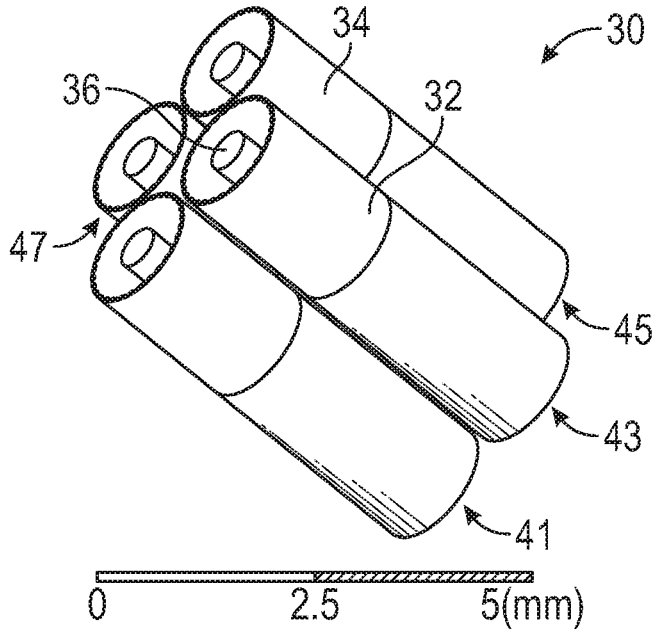
FIG. 3 illustrates a side perspective view of a cable direct connector apparatus for an EMI enclosure, in accordance with an example embodiment.

FIG. 3 illustrates a side perspective view of a cable direct connector apparatus 30 for a group of EMI enclosures or chambers, in accordance with an example embodiment. The cable direct connector apparatus 30 includes a group of chambers 41, 43, 45, 47 each configured in an arrangement similar to that shown in FIG. 1-2. That is, for example, each chamber 41, 43, 45, 47 may be a Gaussian/Faraday enclosure or chamber such as chamber 11 described previously and can be grouped in an arrangement such as the plug house 20 shown in FIG. 2. It can be appreciated that although only four chambers 41, 43, 45, 47 are depicted in FIG. 3 (and similarly, FIG. 4), many more chambers can be implemented in accordance with various embodiments.

The example embodiment shown in FIG. 3 can be implemented in the context of, for example, 85 ohm differential receptacles for 30 AWF 85 ohm micro-coax cables. It can be appreciated that such parameters are not limiting features of the disclosed embodiments but are discussed herein for exemplary purposes only. An example receptacle is the cable core receptacle 36 shown in FIG. 3, which is maintained by the chamber 43 within a cylindrical body 32. That is, chamber 42 includes the cylindrical body 32. Similarly, chamber 45 maintains a cylindrical body 34 and so on (i.e., the other chambers are configured with a similar arrangement).

Figure 4:
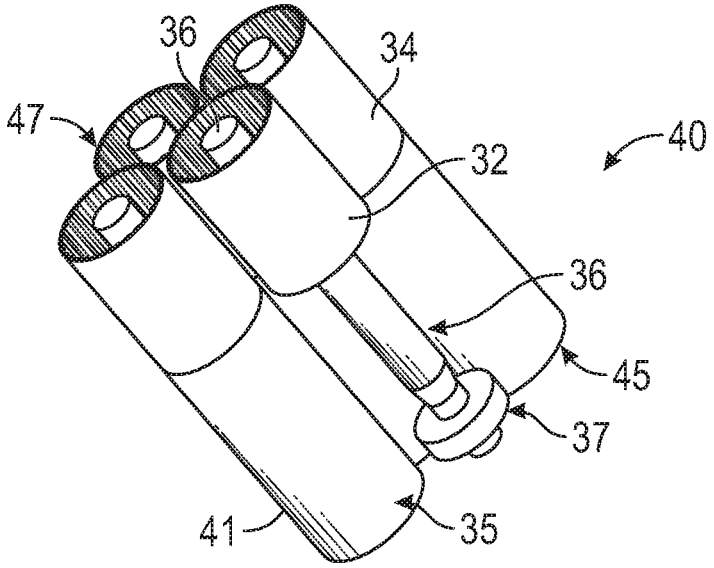
FIG. 4 illustrates a side perspective view of a cable direct connector apparatus for an EMI enclosure shown in FIG. 4, in accordance with an example embodiment.

FIG. 4 illustrates a side perspective view of the cable direct connector apparatus 40 for the EMI enclosures or chambers shown in FIG. 3, in accordance with an example embodiment. Note that in FIG. 3-4, similar or identical parts or elements are generally indicated by identical reference numerals. Note that the view of apparatus 40 shown in FIG. 4 represents a more detailed view of the apparatus 30 shown in FIG. 3. Thus, FIG. 4 shows an example PE support/impedance tuner 37 with respect to the cable core receptacle 36. In addition, an example chamber outer housing 35 is shown with respect to chamber 41.

The embodiments described herein thus include a connector arrangement for use with an EMI enclosure such as, for example, a Gaussian/Faraday chamber (e.g., an enclosure) or cage. The core concept of such embodiments is that each signal or pair of signals will be contained within its own Faraday cage or Gaussian chamber: namely, a metal cylinder wherein all chambers are commonly grounded. It is certainly preferable for each single/paired signal to be contained within its own chamber, but this does not have to be the case and is not considered a limiting feature of the disclosed embodiments. The potential for the disclosed embodiments can be demonstrated in the following example SI parameters: namely, 1) a little over a tenth of a dB in IL, 2) less than −25 dB RL up to 15 Ghz (30 Gbps data rate), and +/−2 Ohms impedance, as demonstrated by the simulation data shown in FIGS. 5-10.

Figure 5:
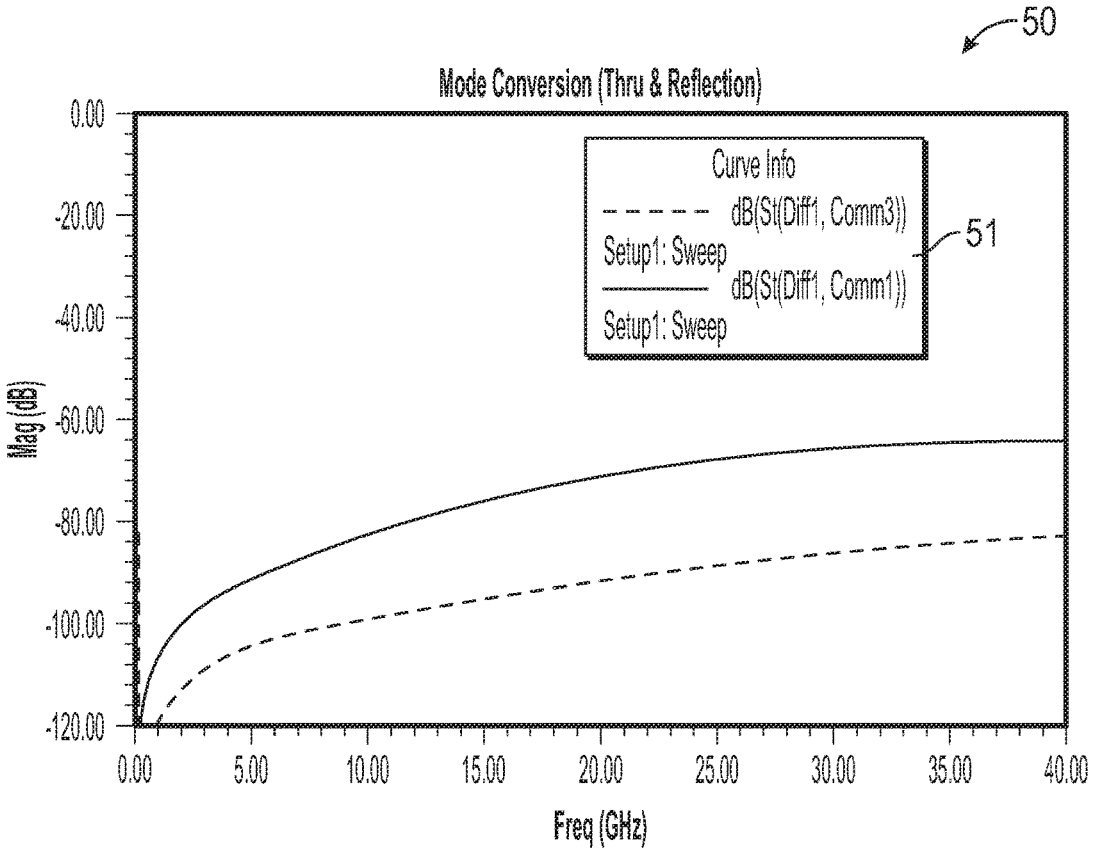
FIG. 5 illustrates a graph of mode conversion data, in accordance with an example embodiment.
Figure 6:
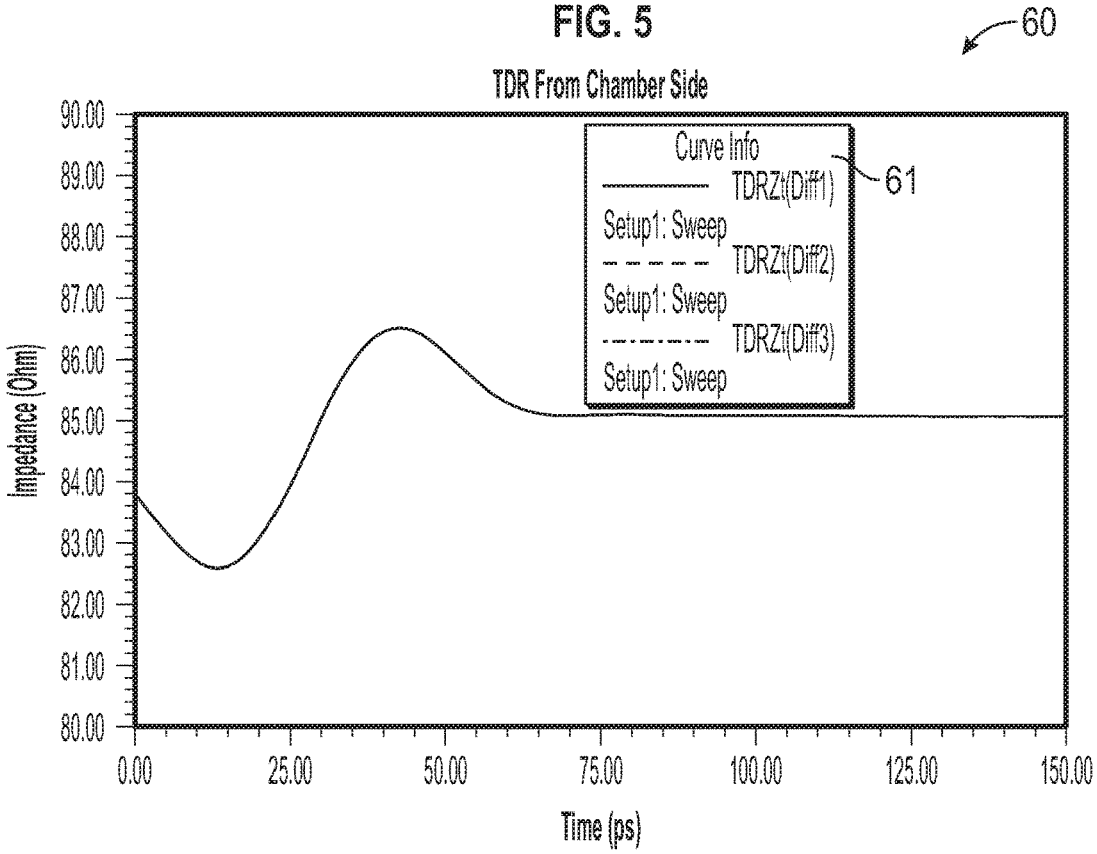
FIG. 6 illustrates a graph depicting data indicative of TDR from a chamber slide, in accordance with an example embodiment.

FIG. 5 illustrates a graph 50 of mode conversion data, in accordance with an example embodiment. The inset 51 shown in FIG. 1 indicates particular curve information with respect to the data curves shown in FIG. 5. FIG. 6 illustrates a graph 60 depicting data indicative of TDR from a chamber slide, in accordance with an example embodiment. The inset 61 shown in FIG. 1 indicates particular curve information with respect to the data curves shown in FIG. 5.

Figure 7:
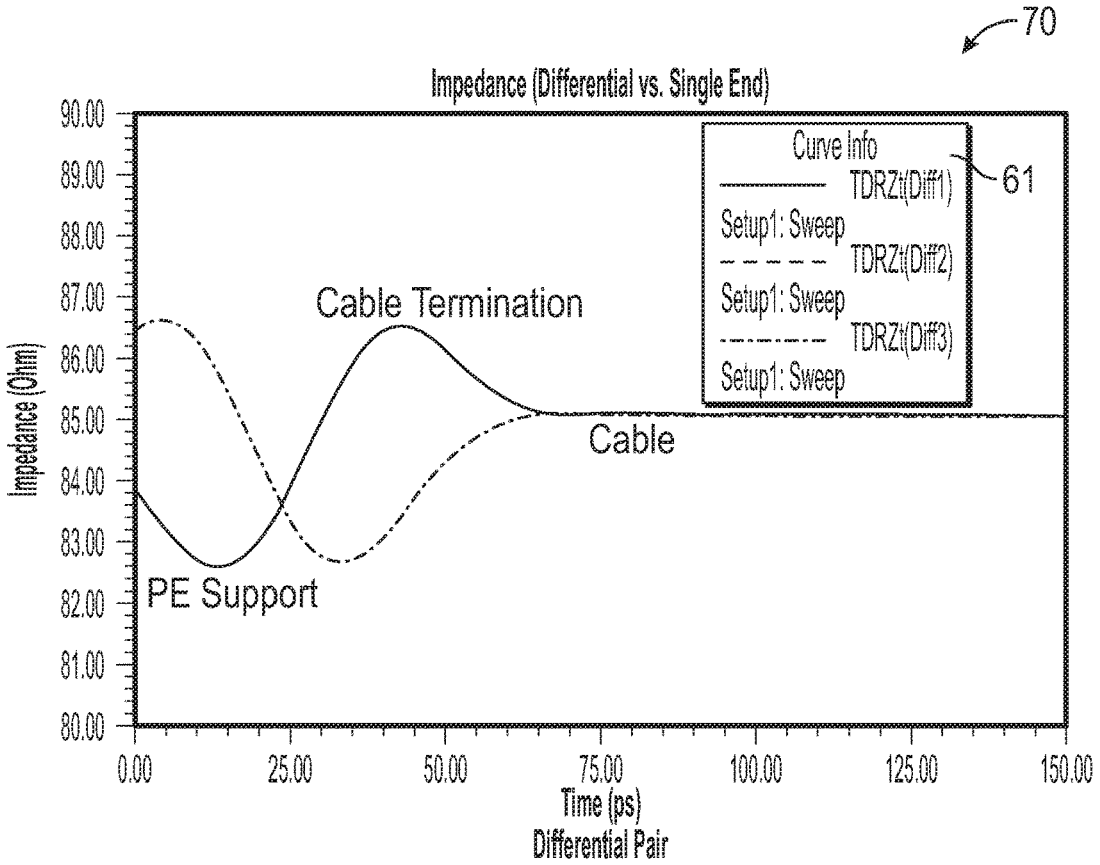
FIG. 7-8 illustrate graphs depicting impedance data for a differential pair and a single end arrangement, in accordance with example embodiments.
Figure 8:
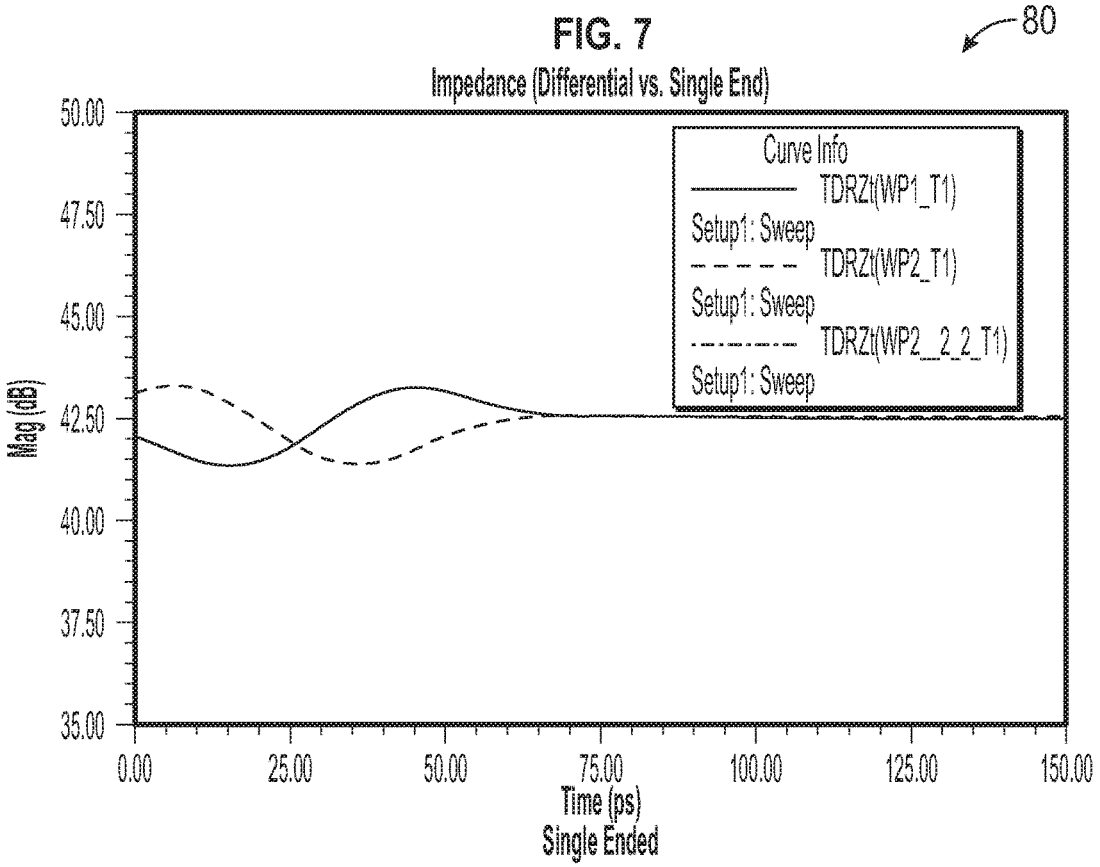
Figure 9:
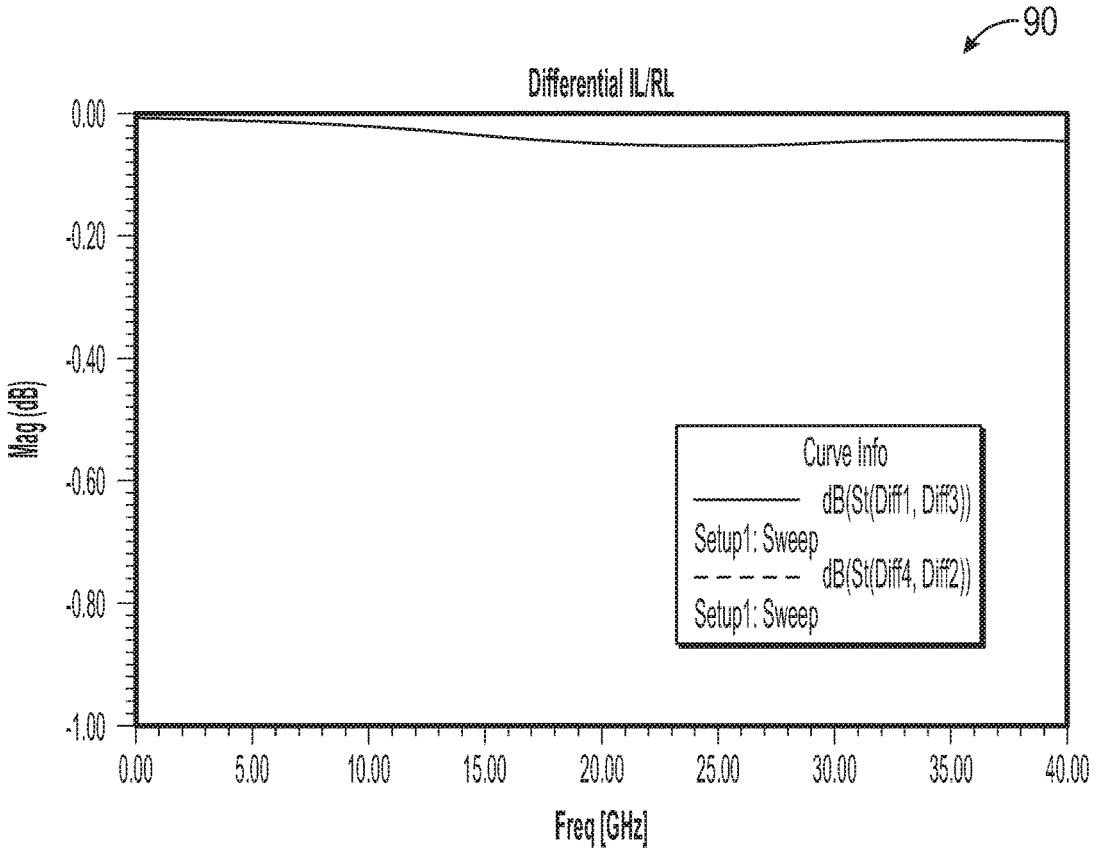
FIGS. 9-10 illustrate graphs depicting differential IL/RL data, in accordance with example embodiments.
Figure 10:
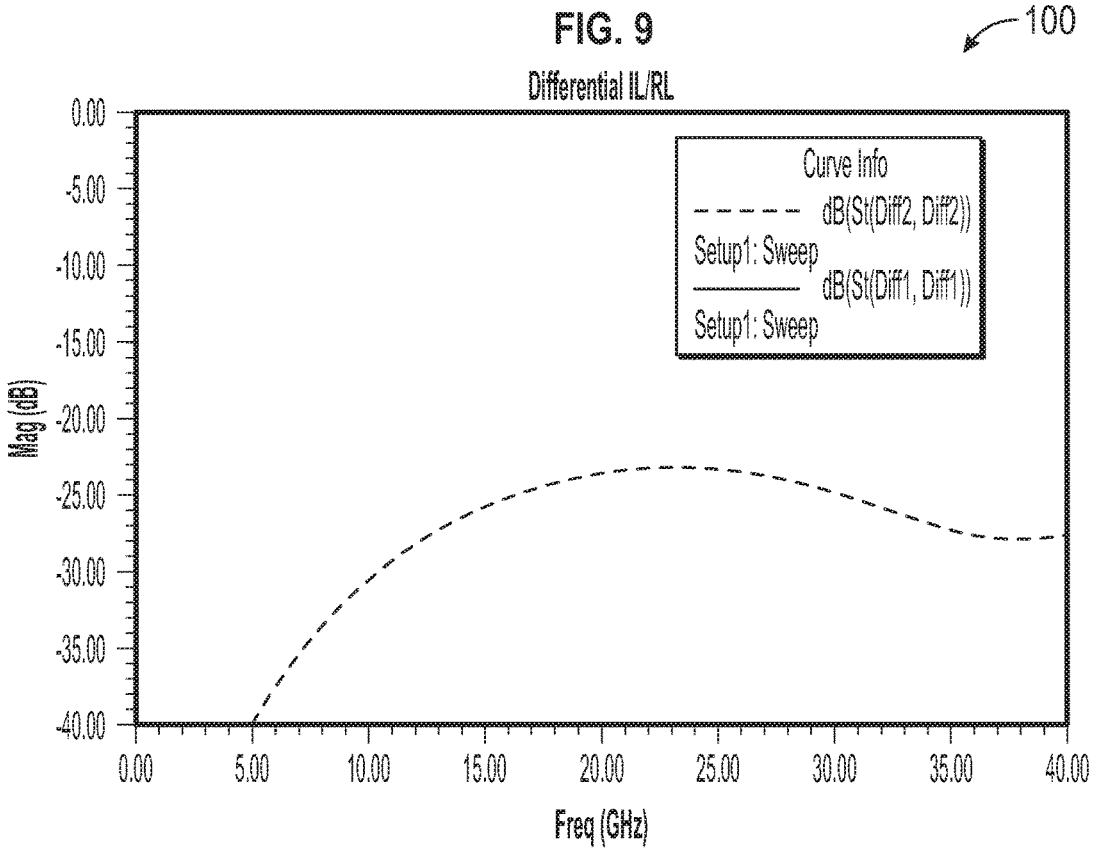

FIG. 7 and FIG. 8 illustrate graphs 70 and 80 depicting impedance data for a differential pair and a single end arrangement, in accordance with an example embodiment. Graph 70, for example, includes differential pair data with data indicating PE support, cable termination and cable data. Graph 80 plots data with respect to a single ended arrangement. FIG. 9 and FIG. 10 illustrate graphs 90 and 100 depicting differential IL/RL data, in accordance with an example embodiment.

The disclosed embodiments thus relate to connector systems, methods and devices for an EMI enclosure such as a Gaussian/Faraday cage or chamber are disclosed herein. The disclosed connector system, method and/or apparatus can be configured to include one or more individual conductors located within the EMI enclosure to eliminate EMI/E&H field effects with respect to applications such as a small form factor cable applications, high density cable applications, and a high speed (e.g., greater than 1 Gbps) multiconductor copper-based cable applications. Such a Gaussian/Faraday chamber cable direct connector therefore isolates individual (or paired) cable signals (e.g., single conductors) within individual Gaussian/Faraday cages to eliminate EMI/E&H field effects for small form factor, high density, high speed (e.g., >1 Gbps) multiconductor copper based cable applications.

Based on the foregoing, it can be appreciated that preferred and alternative example embodiments are disclosed herein. For example, in one embodiment a connector apparatus for an EMI (Electromagnetic Interference) enclosure can be implemented. Such a connector apparatus can include one or more conductors centrally and respectively located within one or more EMI enclosures that eliminates EMI field effects with respect to one or more of the following cable applications: a small form factor cable application, a high density cable application, and a high speed multiconductor copper-based cable application. Note that the aformentioned "one or more conductors" can in some embodiments be implemented in the context of a pair of conductors to support the preponderance of differential signaling used in high speed data transmission and/or also to support multiple pair sets.

In some example embodiments, the aforementioned EMI enclosure can be configured as a geometrically shaped chamber. In another example embodiment, an insulator ring can be disposed within the geometrically shaped chamber. The insulator ring generally surrounds an internal enclosing geometrical component that includes a solder terminated component. The internal enclosing geometrical component in turn surrounds the conductor and a contact pin "mated set" that is configured to match a wire gauge of the conductor (or conductors).

In another example embodiment, a plug house can be implemented, which maintains the aforementioned EMI enclosure (or EMI enclosures) among a plurality of EMI enclosures. In some example embodiments, the aforementioned high speed multiconductor copper-based cable application can include a high speed of greater than 1 Gbps. In still another example embodiment, the aformentioned EMI enclosure can include a Gaussian chamber. In another example embodiment, the aformentioned EMI enclosure can include a Faraday cage. In still another example embodiment, the aformentioned EMI enclosure can include a Gaussian/Faraday cage comprising either or, or a combination of a Gaussian chamber and a Faraday cage.

In another example embodiment, a connector apparatus for an EMI (Electromagnetic Interference) enclosure, can be implemented which includes one or more conductors centrally and respectively located within at least one EMI enclosure comprising a geometrically shaped chamber that eliminates EMI field effects with respect to at least one of the following cable applications: a small form factor cable application, a high density cable application, and a high speed multiconductor copper-based cable application; and an insulator ring disposed within the geometrically shaped chamber, wherein the insulator ring surrounds an internal geometrically enclosing component that may be welded or soldered and wherein the internal enclosure component in turn surrounds the at least one conductor and a contact pin that is configured to match a wire gauge of the at least one conductor.

In still another example embodiment, a connector apparatus for an EMI (Electromagnetic Interference) enclosure, can be implemented, which includes a plug house that maintains at least one EMI enclosure among a plurality of EMI enclosures; and at least one conductor centrally and respectively located within the at least one EMI enclosure, wherein the at least one EMI enclosure is configured to eliminate EMI field effects with respect to at least one of the following cable applications: a small form factor cable application, a high density cable application, and a high speed multiconductor copper-based cable application.

It will be appreciated that variations of the above-disclosed and other features and functions, or alternatives thereof, may be desirably combined into many other different systems or applications. It will also be appreciated various presently unforeseen or unanticipated alternatives, modifications, variations or improvements therein may be subsequently made by those skilled in the art, which are also intended to be encompassed by the following claims.

What is claimed is:

1. A connector apparatus for an EMI (Electromagnetic Interference) enclosure, comprising:

at least one conductor centrally and respectively located within at least one EMI enclosure comprising a geometrically shaped chamber, wherein said at least one EMI enclosure facilitates inter and intra pair signal isolation and eliminates EMI field effects with respect to the following cable applications: a small form factor cable application, a high density cable application, and a high speed multiconductor copper-based cable application; and an insulator ring disposed within said geometrically shaped chamber, wherein said insulator ring surrounds an internal enclosing geometrical component that includes a soldered terminated component and wherein said internal enclosing geometrical component in turn surrounds said at least one conductor.

2. The connector apparatus of claim 1 wherein said at least one conductor comprises a coaxial wire composite center conductor and wherein said geometrically shaped chamber is fully grounded and protects said coaxial wire composite center conductor from EMI interference.

3. The connector apparatus of claim 2 wherein said at least one EMI enclosure further comprises a cable core receptacle and an impedance tuner with respect to the cable core receptacle.

4. The connector apparatus of claim 1 further comprising:

a plug house that maintains said at least one EMI enclosure among a plurality of EMI enclosures; and a contact pin mated set that is configured to match a wire gauge of said at least one conductor.

5. The connector connector apparatus of claim 1 wherein said high speed multiconductor copper-based cable application includes a high speed of greater than 1 Gbps.

6. The connector apparatus of claim 1 wherein said at least one EMI enclosure comprises a Gaussian chamber.

7. The connector apparatus of claim 1 wherein said at least one EMI enclosure comprises a Faraday cage.

8. The connector apparatus of claim 1 wherein said at least one EMI enclosure comprises a combination of a Gaussian chamber and a Faraday cage.

9. A connector apparatus for an EMI (Electromagnetic Interference) enclosure, comprising:

at least one conductor centrally and respectively located within at least one EMI enclosure comprising a geometrically shaped chamber facilitates inter and intra pair signal isolation and eliminates EMI field effects with respect to the following cable applications: a small form factor cable application, a high density cable application, and a high speed multiconductor copper-based cable application;

an insulator ring disposed within said geometrically shaped chamber, wherein said insulator ring surrounds an internal geometrically enclosing component that may be welded or soldered and wherein said internal enclosure component in turn surrounds said at least one conductor and a contact pin that is configured to match a wire gauge of said at least one conductor; and an impedance tuner.

10. The connector apparatus of claim 9 further comprising a plug house that maintains said at least one EMI enclosure among a plurality of EMI enclosures, and wherein said at least one EMI enclosure comprises a cable core receptacle and said impedance tuner with respect to the cable core receptacle.

11. The connector apparatus of claim 9 wherein said high speed multiconductor copper-based cable application includes a high speed of greater than 1 Gbps.

12. The connector apparatus of claim 9 wherein said at least one EMI enclosure comprises a Gaussian chamber.

13. The connector apparatus of claim 9 wherein said at least one EMI enclosure comprises a Faraday cage.

14. The connector apparatus of claim 9 wherein said at least one EMI enclosure comprises a Gauss/Faraday cage comprising a combination of a Gauss chamber and a Faraday chamber Gauss/Faraday chambers.

15. A connector apparatus for an EMI (Electromagnetic Interference) enclosure, comprising:

a plug house that maintains at least one EMI enclosure among a plurality of EMI enclosures, wherein said at least one EMI enclosure comprises a geometrically shaped chamber;

at least one conductor centrally and respectively located within said at least one EMI enclosure, wherein said at least one EMI enclosure eliminates EMI field effects with respect to the following cable applications: a small form factor cable application, a high density cable application, and a high speed multiconductor copper-based cable application.

16. The connector apparatus of claim 15 further comprising an insulator ring disposed within said geometrically shaped chamber, wherein said insulator ring surrounds an internal geometrical component that includes a soldered slit and wherein said internal geometrical component in turn surrounds said at least one conductor and a contact pin that is configured to match a wire gauge of said at least one conductor.

17. The connector apparatus of claim 15 wherein said plug house is configured in a honeycomb arrangement for maintaining said plurality of EMI enclosures.

18. The connector apparatus of claim 15 wherein said high speed multiconductor copper-based cable application includes a high speed of greater than 1 Gbps.

19. The connector apparatus of claim 15 wherein said at least one EMI enclosure comprises at least one of a Gaussian chamber, a Faraday cage, or a combination of said Gaussian chamber and said Faraday cage.

* * * * *